United States Patent [19]

Glenister

[11] 4,454,660

[45] Jun. 19, 1984

[54] ATTACHMENT ASSEMBLY FOR MOUNTING AN INSULATING BLANKET ON A DRYER CYLINDER

[75] Inventor: Bryan J. Glenister, Beaconsfield, Canada

[73] Assignee: Scapa Fab, Inc., St. Laurent, Canada

[21] Appl. No.: 366,220

[22] Filed: Apr. 7, 1982

[51] Int. Cl.[3] ..... F26B 13/08

[52] U.S. Cl. ..... 34/41; 34/110; 34/124; 165/89

[58] Field of Search ..... 34/110, 119, 124, 41; 162/375, 378, 379, 207; 165/89, 146, 185

[56] References Cited

U.S. PATENT DOCUMENTS

| | | |
|---|---|---|
| Re. 25,927 | 12/1965 | Justus et al. . |
| 1,076,330 | 10/1913 | Thompson . |
| 1,640,855 | 8/1927 | Shlick . |
| 2,047,372 | 7/1936 | Jalens . |
| 2,074,455 | 3/1937 | Carleton . |
| 2,413,567 | 12/1946 | Hornbostel . |
| 2,571,426 | 10/1951 | Doniak . |
| 2,591,307 | 4/1952 | Sibel . |
| 3,555,953 | 1/1971 | Irwin . |
| 3,785,922 | 1/1974 | Keller . |
| 4,167,441 | 9/1979 | Keller . |
| 4,241,518 | 12/1980 | Alexy . |
| 4,385,453 | 5/1983 | Withers, Jr. et al. ..... 34/110 |

OTHER PUBLICATIONS

"Hotheads" Advertisement–Pulp & Paper–Jun. 1981.
"Sandy Hill/AMB Heat Cap" advertisement.
"Corcon Dryer Insulators" advertisement.
"Dryer Roll Insulating Covers" advertisement of Innovations Engineering Inc.

*Primary Examiner*—Larry I. Schwartz
*Attorney, Agent, or Firm*—Fleit, Jacobson, Cohn & Price

[57] ABSTRACT

A mounting assembly for securing a thermal insulating blanket to an end of a heated cylinder in a papermaking machine. The assembly includes a clamp positionable on heads of bolts used to secure peripheral portions of the cylinder end to a cylindrical main body. Each clamp includes a spring-wire fastener element positioned around a bolt head and a hold-down clamp for preventing removal of the fastener element from the bolt head. An insulating blanket has an outer skirt portion provided with grommets engageable with engagement portions of the fastener elements. The inner skirt portion of the insulating blanket is secured to a journal of the cylinder by a hose-type clamping device or other suitable device having an elongate member that is wrapped around the skirt portion, with overlapping ends of the elongate member being secured to each other to securely clamp the inner skirt portion of the blanket to the journal.

12 Claims, 8 Drawing Figures

ATTACHMENT ASSEMBLY FOR MOUNTING AN INSULATING BLANKET ON A DRYER CYLINDER

BACKGROUND OF THE INVENTION

1. Field of the Invention

The present invention provides a mounting assembly for connecting insulating blankets to the axial end faces of heated cylinders. More particularly, the invention provides such as assembly especially designed for use with the dryer cylinders of papermaking machines.

2. Description of the Prior Art

A thermal insulation end panel assembly for the dryer cylinder of a papermaking machine is described in U.S. Pat. No. 4,241,518. As noted in such patent, a heatable dryer cylinder for the drying of paper webs and the like conventionally comprises a metal cylindrical body, annular cylinder ends, and opposed central shafts for rotating the cylinder about its axis. The cylinder ends are bolted to the body of the cylinder, at the outer circumferential portions, with the heads of the bolts being positioned on the exterior surfaces of the cylinder ends. The central portions of the cylinder ends are connected to or integral with journals surrounding the central shafts.

The patent describes a connection system for connecting thermal panels to ends of the cylinder to prevent heat loss. Such connection system includes stud clamps that are connected to heads of some of the bolts. Each of the stud clamps has a clamping body secured to a head of the bolt and a headed stud that projects from the clamping body. After the clamping body has been secured on the head of a bolt, a grommet in an end of a thermal panel is positioned over the headed stud and secured in position by a lock nut engaged with an end portion of the shaft of the stud. A seal ring is applied to joined sections of the thermal panel and positioned around the projecting shaft of the cylinder.

While the patent describes the use of a relatively rigid panel, it also is known to use flexible panels to insulate ends of heated cylinders.

A problem encountered with the thermal insulation end panel assembly described in U.S. Pat. No. 4,241,518 is the length of time needed to position the end panel assembly on a cylinder. Each of the stud clamps must be bolted to a bolt head, grommets must be aligned with and positioned on each of the shafts of the stud clamps, and nuts must be engaged with each of the stud clamp shafts. Further, the seal ring must be bolted to inner portions of the thermal panel. The large number of threaded connections results in excessive assembly time, and requires that care be exercised by the personnel installing the panel assembly to ensure that the proper torques are applied to the various threaded connections. Further, since the headed stud is rigid and held in a fixed position, precise alignment is required between the grommets of the thermal panel and the studs.

SUMMARY OF THE INVENTION

It is an object of the present invention to provide a mounting assembly for connecting an insulating blanket to the end surface of a dryer cylinder in a speedy and efficient manner by relatively inexperienced personnel.

The assembly uses flexible fastener elements positioned on the heads of the bolts securing the ends to the cylinder body. As a result, precise alignment of the grommets of the insulating blanket with the fastener elements is no longer required.

The fastener elements are secured in positions around the bolt heads by hold-down clamps that frictionally engage side surfaces of the bolt heads. Thus, the threaded connections associated with the stud clamps described in U.S. Pat. No. 4,241,518 have been eliminated with the present invention.

The provision of flexible fastener elements that are held in place by frictional engagement between clamps and bolt heads results in a significant reduction in the amount of time required to secure an insulating blanket on the end surface of the cylinder. Further, such operation can be performed by less skilled personnel than previously required.

Considering the invention in more detail, it provides a mounting assembly for mounting a flexible insulating blanket on an end surface of a dryer cylinder. The blanket has an outer skirt portion provided with grommets for connecting the outer skirt portion to flexible fastener elements. An inner skirt portion of the blanket is provided with a lip for positioning the inner skirt portion around the exterior surface of the journal or shaft of the cylinder. The outer and inner skirt portions of the blanket define a central insulating portion.

In a presently preferred embodiment of the invention, the fastener elements, or spring clips, are secured to grommets provided in an outer skirt portion of the insulating blanket. When mounting the blanket on the cylinder end surface, the fastener elements are positioned on the heads of bolts that secure the cylinder end to the cylinder body, and hold-down clamps are applied to the bolt heads to retain the fastener elements on the bolt heads. Alternatively, the fastener elements are positioned on the bolt heads; the hold-down clamps are applied to the bolt heads to secure the fastener elements; and the grommets of the insulating blanket are engaged with portions of the fastener elements.

In a modification of the present invention, the grommets of the insulting blanket are sized to fit over the bolt heads. After a grommet has been positioned on a bolt head, the hold-down clamp is applied to the bolt head to secure the grommet. The grommet opening preferably is slightly larger than the exterior dimension of the bolt head to facilitate alignment and positioning of the grommet on the bolt head.

A clamping device similar to a hose clamp is provided to secure the inner skirt portion of the blanket to the hub or journal of the cylinder.

The foregoing and other objects of the invention shall become more readily evident from the following detailed description of preferred embodiments thereof, when considered in conjunction with the drawings.

BRIEF DESCRIPTION OF THE DRAWINGS

In the following description, reference is made to the accompanying drawings, in which.

DESCRIPTION OF THE PREFERRED EMBODIMENTS

Figure 4:
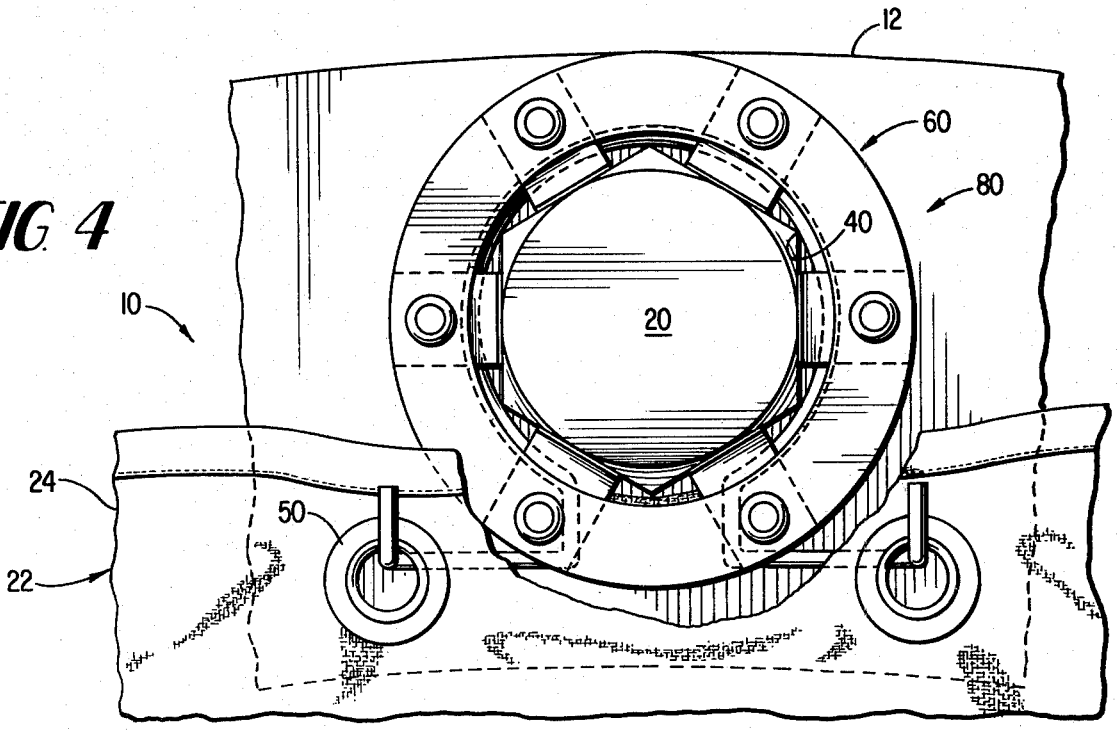
FIG. 4 is a plan view of the hold-down clamp of FIG. 1 and the fastener element of FIG. 3 positioned on a bolt securing a cylinder end wall to the body of a dryer cylinder.
Figure 5:
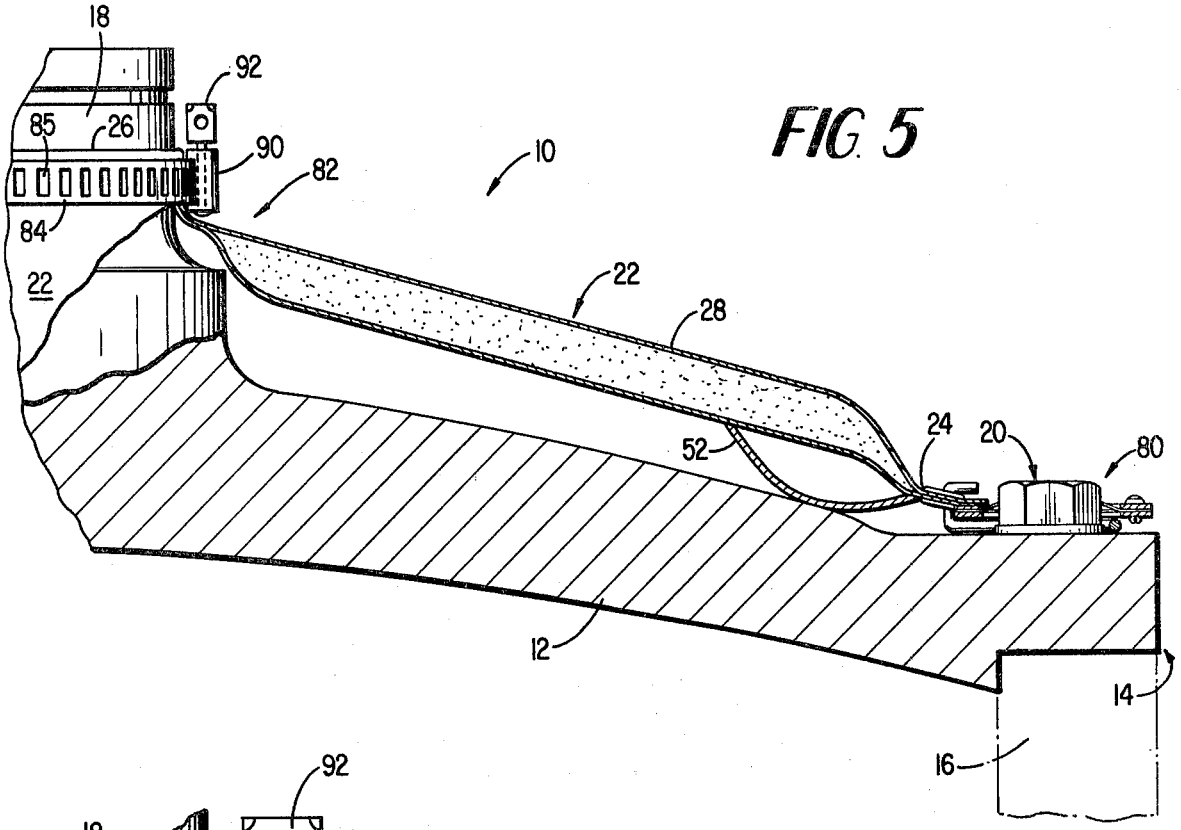
FIG. 5 is an schematic sectional view illustrating the assembly positioned on and thermally insulating the end surface of a dryer cylinder.

Referring now to the drawings, and to FIGS. 4 and 5 in particular, one embodiment of the present invention provides an assembly, generally designated 10, for thermally insulating the end surface 12 of a dryer cylinder, generally designated 14 in FIG. 5. The cylinder 14 includes a cylindrical body 16 that is rotatable about axles or journals 18 at both ends thereof. The end 12 has a hub or shaft portion integral with, connected to, or rotatable about the journal 18. An outer peripheral portion of end 12 is secured by bolts, generally designated 20, to end portions of the cylindrical body 16.

The assembly 10 includes a flexible insulating blanket, generally designated 22, having an outer skirt portion or flange 24 and an inner skirt portion 26. A central portion 28 of the blanket 22 is filled with insulating material. The insulating blanket forms a continuous insulating shield for the end 12.

Figure 3:
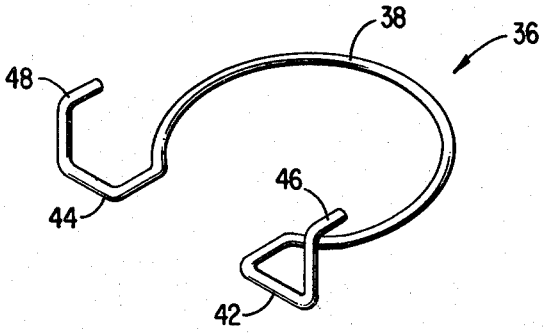
FIG. 3 is a perspective of one embodiment of a fastener element forming another part of an assembly for thermally insulating an end of a dryer cylinder.

Referring now to FIG. 3, one embodiment of a fastener element or wire spring, generally designated 36, is illustrated. The fastener element 36 has a central portion 38 that is positionable in contact with apices of side faces 40 of the bolt 20, as illustrated in FIG. 4. Intermediate portions 42 and 44 of the fastener element are connected to and extend outwardly from the ends of central portion 38. Engagement portions 46 and 48 are connected to and extend upwardly from the intermediate portions 42 and 44, respectively. Preferably, the engagement portions 46 and 48 are generally C-shaped or hook-shaped.

As illustrated in FIG. 4, grommets 50 provided in the outer skirt portion 24 of blanket 22 are engageable with the engagement portions 46 and 48 so as to locate the outer skirt portion 24 of the blanket 22 in a position covering the entire outer surface of the cylinder end 12. The engagement portions are resiliently deformable so that precise alignment with the grommets is not required. Preferably, as illustrated in FIG. 5, the central portion 28 of blanket 22 has a shaped portion 52 that minimizes heat loss between the outer skirt portion 24 and the peripheral portion of end 12.

Figure 1:
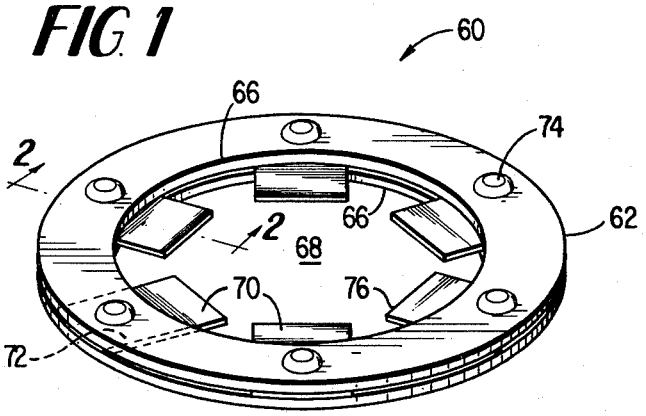
FIG. 1 is perspective of one embodiment of a hold-down clamp forming part of an assembly for thermally insulating an end of a dryer cylinder.
Figure 2:
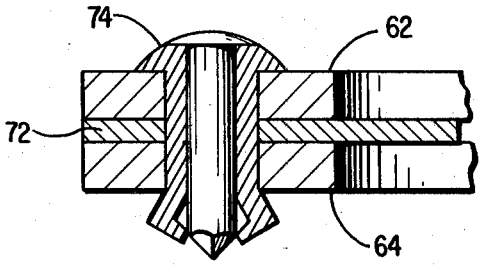
FIG. 2 is a sectional view along line 2—2 of FIG. 1.

Referring now to FIGS. 1 to 3, a clip or hold-down clamp, generally designated 60, is illustrated. The hold-down clamp 60 is positionable over the head of the bolt 20 to prevent removal of the fastener element 36 from the head. The clamp 60 includes a first annular disc 62 and a second annular disc 64. Inner edges 66 of the discs are alignable with each other to define a central opening 68. The diameter of the central opening 68 is sized so that the clamp 60 can be positioned over a bolt 20, as best illustrated in FIG. 4. A plurlity of flexible leaf elements 70 have outer edge portions 72 positioned between and secured to the discs 62 and 64 by suitable fastening means, such as rivets 74, as illustrated in FIG. 2. Inner edge portions 76 of the leaf elements 70 protrude into the central opening 68. The elements 70 are formed from any suitable resiliently deformable or "spring" material, such as spring steel, spring bronze, or plastic.

Representative dimensions of one embodiment of the present invention will now be set forth. It should be appreciated, however, that such dimensions are a function of the configuration of the heads of the bolts used to secure the cylinder end to the main cylindrical body. For instance, when the bolt is a standard $\frac{7}{8}''$ UNC, with a 1 and 5/16" A/F, the discs 62 have an exterior diameter of $2\frac{3}{8}''$ and an interior diameter of $1\frac{3}{4}''$. The thickness of the discs is approximately 3/32". The flexible leaf elements 70 are formed of spring steel between 0.020 and 0.030" thick, with the distance between confronting faces of diagonally opposed elements being 1.26". The distance between the inner edge of a flexible element and the center of the opening is 0.63". The rivets used to secure the discs and flexible elements to each other have a $\frac{1}{8}''$ diameter. The flexible elements are $\frac{1}{2}''$ wide.

Referring now to FIGS. 4 and 5, it can be seen that a clamp or mounting device, generally designated 80, is provided by the combination of the hold-down clamp 60 and the fastener element 36. After the fastener element 36 has been positioned around the side surfaces 40 of the bolt 20, the hold-down clamp 60 is positioned over the head of bolt 20. As the hold-down clamp 60 is being positioned over the head of the bolt 20, the flexible leaf spring elements 70 are deformed outwardly to frictionally engage and exert a holding force on side faces of the bolt. Should any outward force away from the cylinder end be exerted on the hold-down clamp 60 by the engagement portions 46 and 48 of the fastener element 36, such force will act only on a portion of the hold-down clamp so that the clamp will be cammed to provided enhanced locking of the clamp to the bolt.

Figure 6:
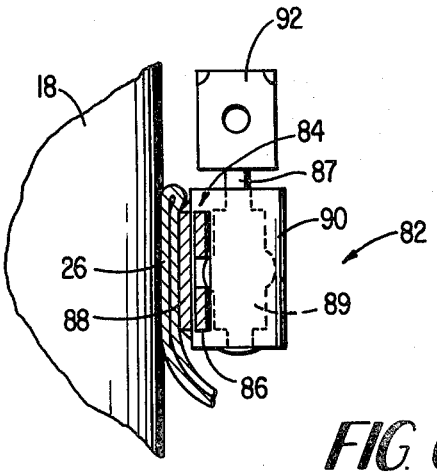
FIG. 6 is an enlarged view of a portion of FIG. 5, illustrating the relationship between an inner skirt portion of the insulating blanket of the assembly, the journal of the cylinder, and a clamping device securing the inner skirt portion to the cylinder journal.

Referring now to FIG. 6, a clamping device, generally designated 82, is illustrated. The clamping device 82 is of the type commonly known as a hose-type strap clamp, and includes an elongated strap member 84 having a length sufficient to encompass the inner skirt portion 26 when the skirt portion is located on the journal 18. An end 86 of the elongate member 84 overlaps an end 88 of the member 84. A device 90 is provided to secure the ends in overlapping relationship so that the ends are movable with respect to each other. The elongate strap member 84 is formed with transversely extending slots or openings 85. Rotation of a knob 92 of the device 90 results in rotation of a shaft 87 that has protruding portions 89 that engage in the openings 85 to incrementally advance the end 86 with respect to the device 90. Other suitable techniques for securing the inner skirt portion 26 include the application of a banding strap made of metal or other durable material that is secured in position by one or more clips, the application of a strap that surrounds the journal 18 and has confronting ends bolted or otherwise secured to each other, and the application of a radiator-type water hose clamp.

Considering now the use of the assembly illustrated in FIGS. 1 to 6, a suitable number of mounting devices 80 are positioned on or secured to the bolts 20. This is accomplished by first placing fastening devices 36 around a suitable number of bolt heads. Hold-down clamps 60 are then positioned on the bolts to secure the fastener elements between the clamps nd the cylinder end 12. An insulating blanket 22 is then positioned on the cylinder end, around journal 18, with grommets 50 carried by the outer skirt portion 24 being engaged with the hook-shaped portions 46 and 48 of the fastener elements 36. The inner skirt portion 26 is located on the journal 18, and the clamping device 82 is secured in position around the inner skirt portion 26 to clamp the skirt portion to the journal. In this manner, the blanket is efficiently and rapidly secured in a position insulating the cylinder end.

Figure 7:
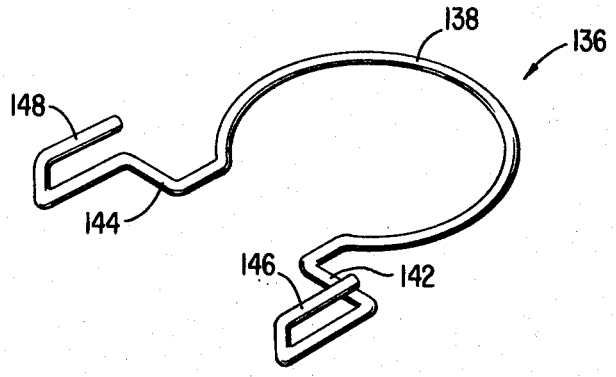
FIG. 7 is a view similar to FIG. 3, illustrating a presently preferred embodiment of a fastener element.
Figure 8:
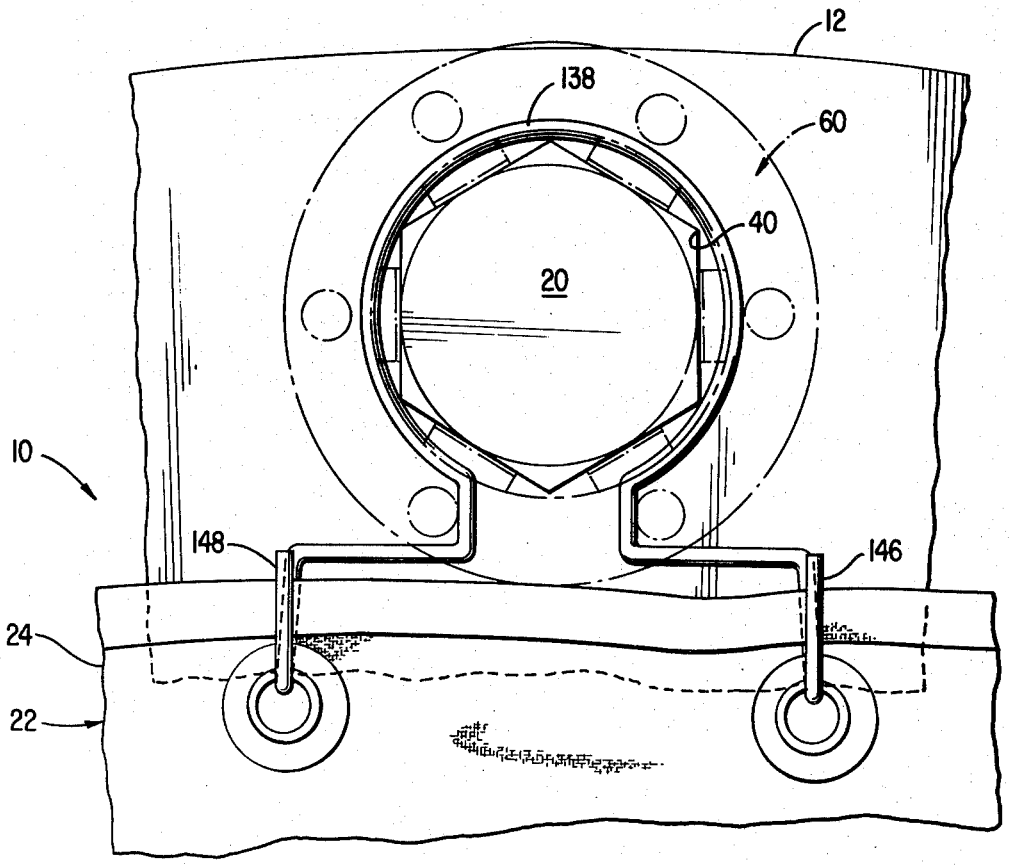
FIG. 8 is a view similar to FIG. 4, combining the hold-down clamp of FIG. 1 with the fastener element of FIG. 7.

Referring now to FIGS. 7 and 8, there is illustrated a presently preferred embodiment of the clamp provided by the present invention. The embodiment combines a clip or hold-down clamp that is the same as the previously described clamp 60, with a flexible fastener element generally designated 136.

As best illustrated in FIG. 7, the fastener element 136 has a central portion 138, intermediate portions 142 and 144, and engagement portions 146 and 148. The intermediate portions have inner ends connected to ends of the central portion and outer ends connected to ends of the engagement portions. The central portion 138 is sized so as to fit over the head of bolt 20. Such size can be slightly smaller than the exterior of the bolt so that the central portion is resiliently deformed and frictionally engages side faces of the bolt. The size also can be the same as or slightly larger than the bolt head because hold-down clamp 60 secures the fastener element 136 in a position in which the central portion 138 encompasses the bolt head.

The intermediate portions 142 and 144, and the engagement portions 146 and 148 are sized and shaped so as to space the peripheral edge of the outer skirt 26 of the blanket 22 a sufficient distance from the bolt 20 to allow positioning of the hold-down clamp 60 on the bolt 20 without interference from the blanket. As illustrated in FIG. 8, the edge of the blanket is inwardly spaced from the bolts 20.

The engagement portions 146 and 148 are designed to be secured to grommets 50 prior to installation of the blanket 22 on the cylinder end surface. After the free ends of the engagement portions have been passed through the grommets, the free ends are bent towards the intermediate portions so that the fastener elements are secured to the blanket prior to placement of the fastener elements on the bolts.

When installing the blanket, it is only necessary to place the fastener elements 136 around the bolts 20, and to apply the hold-down clamps 60 to secure the fastener elements in position.

In another embodiment of the invention, it is contemplated that the grommets of the blanket be sized and located so as to directly fit over the heads of the bolts. Hold-down clamps 60 are then placed over the bolts to secure the grommets, and hence the blanket on the cylinder end.

Previously, specific embodiments of the present invention, in the environment of a dryer cylinder in a papermaking machine, have been described. It should be appreciated, however, that such description has been for the purposes of illustration only, without any intention of limiting the present invention. Rather, it is the intention that the invention should be limited only by the appended claims.

What is claimed is:

1. A clamp for connecting the outer skirt portion of an insulating blanket to an end of a heated cylinder in a papermaking machine, the cylinder end having a plurality of bolt heads protruding therefrom, said clamp comprising:

a fastener element having a central portion shaped to fit over and partially encircle side surfaces of a bolt head, intermediate portions connected to and extending outwardly from end portions of said central portion, and flexible engagement portions extending from outer end portions of said intermediate portions, said engagement portions being resiliently deformable and engageable with the outer skirt portion of the insulating blanket to connect the blanket to the cylinder end through the means of the fastener element; and clip means engageable with said surfaces of the bolt head for preventing removal of a fastener element positioned on the bolt head.

2. A clamp according to claim 1, wherein said clip means comprises:

a first disc having an inner edge defining a central opening shaped to fit over and encircle side surfaces of the bolt head;

a plurality of flexible leaf elements having outer end portions carried by said first disc and inner end portions extending into the central opening, said leaf elements being resiliently deformable when said first disc is fitted over the bolt head to frictionally engage and to exert clamping forces on said side surfaces of the bolt head.

3. A clamp according to claim 2, wherein said clip means further comprises a second disc having a central opening, and means for securing said first and second discs to each other with their central openings aligned with each other, said outer end portions of said flexible elements being secured between confronting surfaces of said first and said second discs.

4. A clamp according to claim 1, wherein the central portion of the fastener element has a generally circular shape such that said fastener element contacts apices of the side surfaces of the bolt head when the fastener element is placed on the bolt head.

5. A clamp according to claim 1, wherein the engagement portions of the fastener element are generally hook-shaped and are spaced from the central portion by distances sufficient to allow positioning of said clip means between the engagement portions and the central portion.

6. A method for clamping a central skirt portion of an insulating blanket to an exterior surface of a journal supporting a heated cylinder of a papermaking machine, the method comprising:

positioning the insulating blanket on the cylinder end of the heated cylinder;

placing the central skirt portion of the blanket on the journal;

securing the skirt portion to the journal by a hose-type strap clamp; and tightening the strap clamp to secure the blanket to the journal.

7. An assembly for thermally insulating the end of a heated cylinder of a papermaking machine, wherein the end is secured to a cylinder body by bolts extending through outer circumferential edge portions of the end and having heads positioned on the exterior surface of the end, the cylinder being rotatable about a journal, said assembly comprising:

an insulating blanket having an outer skirt portion carrying grommets and an inner skirt portion;

a plurality of clamping means for securing the grommets of the outer skirt portion to outer circumferential edge portions of the cylinder end; and a clamping device for securing the inner skirt portion to an outer circumferential surface of the journal;

each of said clamping means comprising clip means having a disc with an inner edge defining a central opening shaped to fit over and encircle side surfaces of a bolt head, and a plurality of flexible leaf elements carried by said disc and having inner end portions extending into the central opening, said leaf elements being resiliently deformable when said disc is fitted over a bolt head so that the leaf elements frictionally engage and exert clamping forces on the bolt head thereby securing said clip means to the bolt head.

8. An assembly according to claim 7, wherein each of said clamping means further comprises a fastener element having a central portion shaped to fit over and partially encircle side surfaces of a bolt head, intermediate portions connected to and extending outwardly from end portions of said central portion, and engagement portions extending from outer end portions of said intermediate portions, said engagement portions being resiliently deformable and engageable with the grommets of the outer skirt portion of the insulating blanket to connect the blanket with the fastener element, said clip means being positionable to prevent removal of said fastener element from said bolt head.

9. A method for mounting an insulating blanket having an outer skirt portion and an inner skirt portion on a heated cylinder in a papermaking machine, the method comprising the steps of:

positioning an annular insulting blanket over the outside surface of an end of a heated cylinder;

securing the outer skirt portion of the insulating blanket on the cylinder end by means of the association between resiliently deformable clips mounted on the bolt heads used to hold the cylinder end to the cylinder main body and spaced apart mounting locations on the outer skirt portion; and securing the inner skirt portion to the cylinder end at the central portion thereof.

10. The method of claim 9, wherein insulating blankets are mounted on both ends of the heated cylinder.

11. The method of claim 9, wherein the inner skirt is secured by means of a hose-type clamping member holding the inner skirt to the journal on which the cylinder is mounted.

12. The method of claim 9, further comprising connecting resiliently deformable fastener elements to the mounting locations on the outer skirt portions, and positioning the fastener elements around the bolt heads prior to the mounting of the clips on the bolt heads so that the clips prevent removal of the fastener elements from the bolt heads.

* * * * *